US007847195B2

(12) United States Patent
Tuma

(10) Patent No.: US 7,847,195 B2
(45) Date of Patent: Dec. 7, 2010

(54) ADHESIVE CLOSING DEVICE PROVIDED WITH A SWITCHING CIRCUIT

(75) Inventor: Jan Tuma, Herrenberg (DE)

(73) Assignee: Gottlieb Binder GmbH & Co. KG, Holzgerlingen (DE)

( * ) Notice: Subject to any disclaimer, the term of this patent is extended or adjusted under 35 U.S.C. 154(b) by 1467 days.

(21) Appl. No.: 10/541,827

(22) PCT Filed: Oct. 11, 2003

(86) PCT No.: PCT/EP03/11283

§ 371 (c)(1),
(2), (4) Date: Jul. 11, 2005

(87) PCT Pub. No.: WO2004/062415

PCT Pub. Date: Jul. 29, 2004

(65) Prior Publication Data

US 2006/0131066 A1 Jun. 22, 2006

(30) Foreign Application Priority Data

Jan. 13, 2003 (DE) ..... 103 01 424

(51) Int. Cl.
*H05K 1/00* (2006.01)
*H05K 1/02* (2006.01)

(52) U.S. Cl. ..... 174/250; 174/259

(58) Field of Classification Search ..... 174/250, 174/255, 259
See application file for complete search history.

(56) References Cited

U.S. PATENT DOCUMENTS

| | | | | |
|---|---|---|---|---|
| 4,429,348 | A * | 1/1984 | Dean | 361/757 |
| 5,136,470 | A * | 8/1992 | Sheridon et al. | 361/749 |
| H1471 | H * | 8/1995 | Braun et al. | 361/704 |
| 5,457,610 | A | 10/1995 | Bernardoni et al. | |
| 5,774,341 | A | 6/1998 | Urbish et al. | |
| 5,898,290 | A * | 4/1999 | Beard et al. | 307/150 |
| 6,080,110 | A * | 6/2000 | Thorgersen | 600/500 |
| 6,173,899 | B1 * | 1/2001 | Rozin | 235/492 |
| 6,598,274 | B1 | 7/2003 | Marmaropoulos | |

FOREIGN PATENT DOCUMENTS

DE 196 46 318 5/1998

* cited by examiner

*Primary Examiner*—Jeremy C Norris
(74) *Attorney, Agent, or Firm*—Roylance, Abrams, Berdo & Goodman LLP

(57) ABSTRACT

A closing device (1, 101, 201, 301) includes a plurality of adhesive closing elements (2) in the form of a hook, mushroom head or clasp, and a flat support (3, 103, 203, 303). The adhesive closing elements (2) protruded from at least one surface (4) of the support (3, 103, 203, 303). At least one switching circuit (5, 503) with at least one electric and/or electronic component (6, 106, 7, 107, 207, 307) is provided.

21 Claims, 2 Drawing Sheets

ADHESIVE CLOSING DEVICE PROVIDED WITH A SWITCHING CIRCUIT

FIELD OF THE INVENTION

The present invention relates to an adhesive closure part with a plurality of adhesive closure elements projecting from a carrier and with a circuit having an electrical or electronic component on the carrier side opposite the adhesive closure elements.

BACKGROUND OF THE INVENTION

These adhesive closure parts are known, for example, from DE 196 46 318 A1. An adhesive closure generally formed from two adhesive closure parts dynamically connectible to one another is often used in textile or other articles of clothing and is also know as a Velcro-type closure. Further applications are, for example, installation technology, for example, for attaching elements of the inside lining in automotive engineering, or in general the production of a detachable mounting.

U.S. Pat. No. 5,774,341 discloses an adhesive closure part with a woven carrier in which metallic filament threads are interlaced. For purposes of electrical through-plating of the carrier from one side to the other side, the metallic filament threads project out to either side of the carrier. On one side loops formed by the metallic filament threads are cut open into hooks and form hook-like adhesive closure elements. On the other side metal surfaces can make electrical contact by the hook-shaped adhesive closure elements and are applied to the segments of the metallic filament threads projecting out of the surface of the carrier.

U.S. Pat. No. 5,457,610 discloses a substrate partially metal-coated to form electrical connection points. Adhesive closure elements are applied to the metal coating to be able to mechanically fix the electrical components.

U.S. Pat. No. 6,598,274 discloses an adhesive closure part with hook elements formed from a shape memory alloy. Due to an electrical current impressed from the outside through the hook-shaped adhesive closure elements they change their shape, especially they assume a non-interlocking form.

SUMMARY OF THE INVENTION

An object of the present invention is to provide adhesive closure parts and adhesive closures with increased functionality.

This object is basically achieved by the adhesive closure part with a plurality of adhesive closure elements, for example, hooks, mushrooms or loops. The adhesive closure part has a flat carrier produced from a thermoplastic. The adhesive closure elements project from at least one surface of the carrier. The adhesive closure part has a circuit having at least one electrical and/or electronic component. The circuit is located on the side of the carrier opposite the adhesive closure elements.

Preferably, the adhesive closure elements are made of plastic. For example, the plastic can be thermoplastically shaped, and a process as claimed in DE 196 46 318 A1 is used to produce the adhesive closure elements. Alternatively to a thermoplastic, a duroplastic, polymer plastic, acrylate plastic or other suitable plastic can be used. Preferably, the adhesive closure elements are configured integrally with the carrier. Alternatively, the adhesive closure elements can also be produced as described in DE 101 06 705 C1, in particular with an application device by which the adhesive closure elements are built up in successively delivered droplets.

In one special version of the present invention, the electrical and/or electronic component is located on and/or in the flat carrier. To the extent the component is located on the surface of the carrier, this can take place in an area which is free of adhesive closure elements. In particular, the adhesive closure elements can be located on only one side of the carrier and the component can be located on the opposing side of the carrier. Depending on the respective application case the component can also be located between or on the adhesive closure elements.

To the extent the component is integrated into the flat carrier, this can take place in a hybrid or even monolithic manner. In particular, the carrier or its material itself can have an electrical and/or electronic functionality. Thus, for example, when a corresponding plastic is used for the carrier there can optionally be locally limited electrical conductivity for making available strip conductors. Alternatively or in addition, the carrier can also have semiconductor properties, at least locally limited, so that circuitry intelligence can be integrated into the compartmented carrier.

In one preferred embodiment, the component is applied to the flat carrier in thick or thin film technology. Thus, for example, electrical conductor strips can also be provided on the carrier by structured or unstructured coating, for example, printing, precipitation or vapor deposition. Packaging technology discloses partially aluminized packaging foils, the aluminum coating for the packaging foils being intended for a completely different purpose, specifically as diffusion barriers. When using the corresponding printing or coating technologies, aluminum strips structured at least in areas, or conductor strips of some other electrically conductive material, can be made available comparatively easily on the carrier.

In this way electrical sensors can also be made available which signal, for example, the application of a force to the adhesive closure part. In this way an adhesive closure part used, for example, to attach a coating material for a motor vehicle seat can at the same time electrically signal whether an individual has sat down on the seat or not, and accordingly the safety devices such as the belt tensioner or airbags of the vehicle can be controlled.

Above and beyond these simple electrical sensors formed essentially by conductor strips, it is possible to implement sensors, actuators and data processing technology of almost any complexity on the carrier. To do this, for example, electronic sensors and/or integrated semiconductor components can be provided on or in the carrier. At least some of the electrical and/or electronic components can also be applied to another carrier laminated onto the flat carrier of the adhesive closure element or joined to the flat carrier.

For example, so-called smart labels can be implemented by the adhesive closure part according to the present invention. They can be easily attached and removed again as many times as wished on articles of clothing, items or the like as intelligent labels due to the mechanical functionality of the adhesive closure part.

In one special embodiment, the integrated semiconductor component has an electronic data memory. It can be a read-only memory (ROM) or a programmable read-only memory (PROM). In particular, erasable programmable read-only memories (EPROM) or even electronically erasable programmable read-only memories (EEPROM) are advantageous. For example, identification or authorization data can be stored in the data memory. Thus, for example, access authorization to security-relevant spaces, vehicles, functions or the like can be filed in such a data memory.

Alternatively or in addition, biometric features of living creatures, especially of individuals, can be stored which are used for recording and storing characteristic and individual features. Such an adhesive closure part can easily be, for example, detachably mounted on an article of clothing of a correspondingly authorized individual who has the corresponding access authorizations using this adhesive closure part.

In this connection it is especially advantageous if the data stored in the data memory can be read out without contact. Preferably the adhesive closure part forms a type of transponder which in any case transmits some of the stored data upon a corresponding electronic interrogation. The pertinent reading station can be stationary or portable.

The energy required for information transmission between the adhesive closure part and the reading station can be coupled into the circuit in the adhesive closure part without contact by an electromagnetic field. The circuit for this purpose has at least one receiving coil which can also be formed, for example, by a correspondingly structured conductor strip.

Alternatively or in addition, the circuit can have an energy storage device, especially an electrochemical energy storage device in the form of a battery or a rechargeable battery. Alternatively or in addition, capacitive or other energy storage devices can also be used. Preferably the energy storage device is also made using thin or thick film technology so that the adhesive closure part overall has a small thickness.

Preferably data can also be stored in the data memory without contact so that not only can information be read out of the memory, but also new and optionally updated information can be written into the memory. These writing processes preferably also take place without contact, and like the reading process do not require direct visual contact between the adhesive closure part and the reading device. The attainable communications ranges in the corresponding systems are known from other applications and are up to one meter or more. The range is determined essentially by the power of the transmitter and/or by the size of the antenna of the read/write device. When an energy storage device integrated into the adhesive closure part is used, fundamentally longer ranges can be achieved.

The applications of these intelligent adhesive closure parts are very widely diversified. In particular they can be used for applications for which adhesive closure parts have not been used in the past. The mechanical functionality of the adhesive closure part allows simple and repeatable attachment and removal of electronic intelligence on individuals or articles of clothing or on items. Since transmission of the information does not require visual contact, the adhesive closure parts can also be located hidden, for example, on the inside of an article of clothing or on the side of an item which is not visible.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
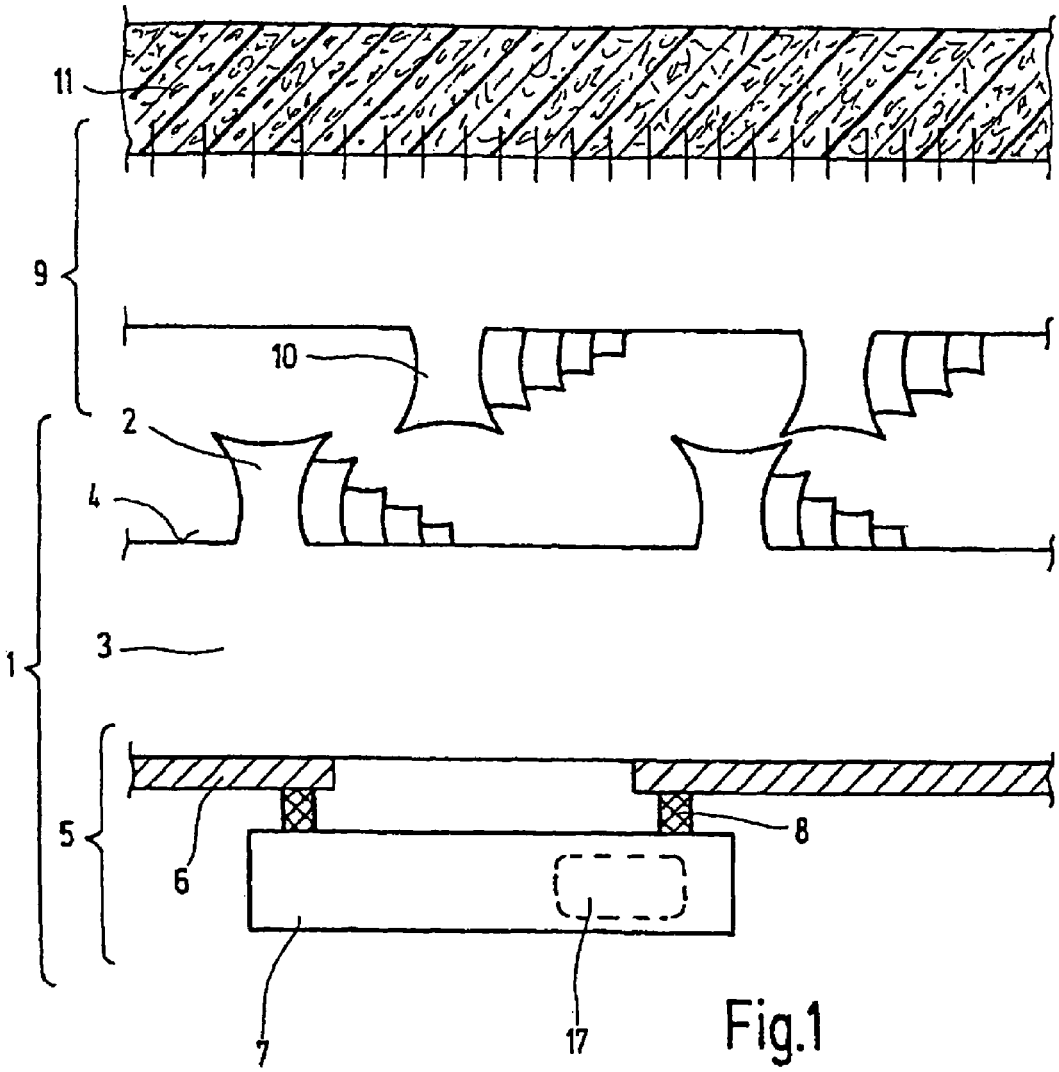
FIG. 1 is a side elevational view in section through an adhesive closure with an adhesive closure part according to a first exemplary embodiment according to the present invention.

FIG. 1 shows a cross section through an adhesive closure with an adhesive closure part 1 according to a first exemplary embodiment of the present invention. The closure part 1 has a plurality of adhesive closure elements 2 regularly located in rows and columns and formed integrally with the flexible flat carrier 3 from a formable thermoplastic. Closure elements 2 project from one or a first surface 4 of the carrier 3 angularly, preferably at a right angle. On the surface opposite the adhesive closure elements 2, the adhesive closure part 1 has a circuit 5 which in this embodiment has both an electrical component in the form of a conductor strip 6 and an electronic component in the form of an integrated semiconductor component 7.

The printed conductors 6 are formed by a structured aluminum coating directly on the side of the carrier 3 facing away from the adhesive closure elements 2. The connection to the terminal electrodes of the semiconductor component 7 takes place by bumps 8. The function and complexity of the semiconductor component 7 are matched to the respective application. In this way the semiconductor component 7 can comprise, for example, essentially of a temperature sensor, optionally with a storage means for regular or event-dictated storage of determined temperature values, for example, when a given temperature value is exceeded or not reached. To do this, the semiconductor component 7 in one partial area has a data memory 17 from which data can be read out preferably without contact and data can be stored likewise preferably without contact. These data can be routed by the conductor strips 6 to outside the adhesive closure part 1. In another application, the semiconductor component 7 can contain, for example, a complete transponder which communicates identification data without contact with a corresponding read/write device.

The adhesive closure part 1 equipped according to the present invention, by means of the adhesive closure elements 2, can be connected in a mechanically secure but detachable manner to another or second adhesive closure part 9 configured essentially identically with respect to its mechanical functionally by engagement of the adhesive closure elements 2, 10 corresponding to one another. The other adhesive closure part 9 can be sewed, cemented or in some other way applied securely and generally undetachably to a textile or other article of clothing 11. Therefore, the adhesive closure part 1 equipped as according to the present invention can be detachably fixed on an article of clothing 11. The adhesive closure part 1 equipped according to the present invention thus combines the mechanical attachment possibilities of conventional adhesive closures with the more or less complex control function of electrical and/or electronic components and can thus be called a smart fastener or an intelligent adhesive closure.

Figure 2:
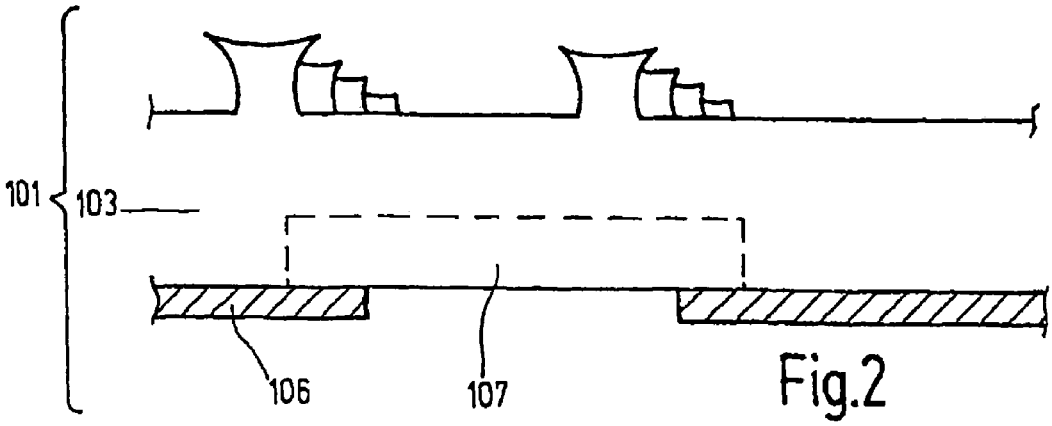
FIG. 2 is a side elevational view in section of an adhesive closure part according to a second exemplary embodiment of the present invention.

FIG. 2 shows a second embodiment of the present invention. The adhesive closure part 101 likewise has a thermoplastically formable carrier 103 into which the semiconductor component 107 is integrated. This integration can be done in hybrid form, for example, by inserting a semiconductor component 107 into a correspondingly provided or impressed recess in the carrier 103. Depending on the capabilities and properties of the carrier 103 and of the pertinent material, the control intelligence can also be monolithically implemented in the material of the carrier 103, for example, by influencing, in a concerted manner, the semiconductor areas which are optionally locally bounded in the carrier 103. Contact-making of the electronic component 107 integrated in a monolithic or hybrid manner takes place in turn by conductor strips 106 produced by structured coating of the corresponding surface of the carrier 103.

Figure 3:
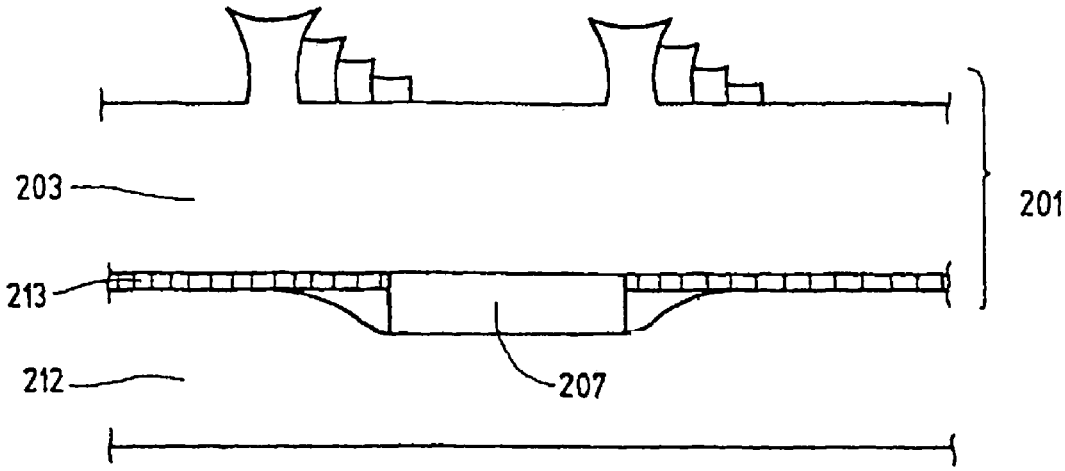
FIG. 3 is a side elevational view in section of an adhesive closure part according to a third exemplary embodiment of the present invention.

FIG. 3 shows a third embodiment of the present invention. Here the electronic component 207 is applied to another carrier 212 laminated onto the flat carrier 203 of the adhesive closure element 201 by a cement layer 213.

Figure 4:
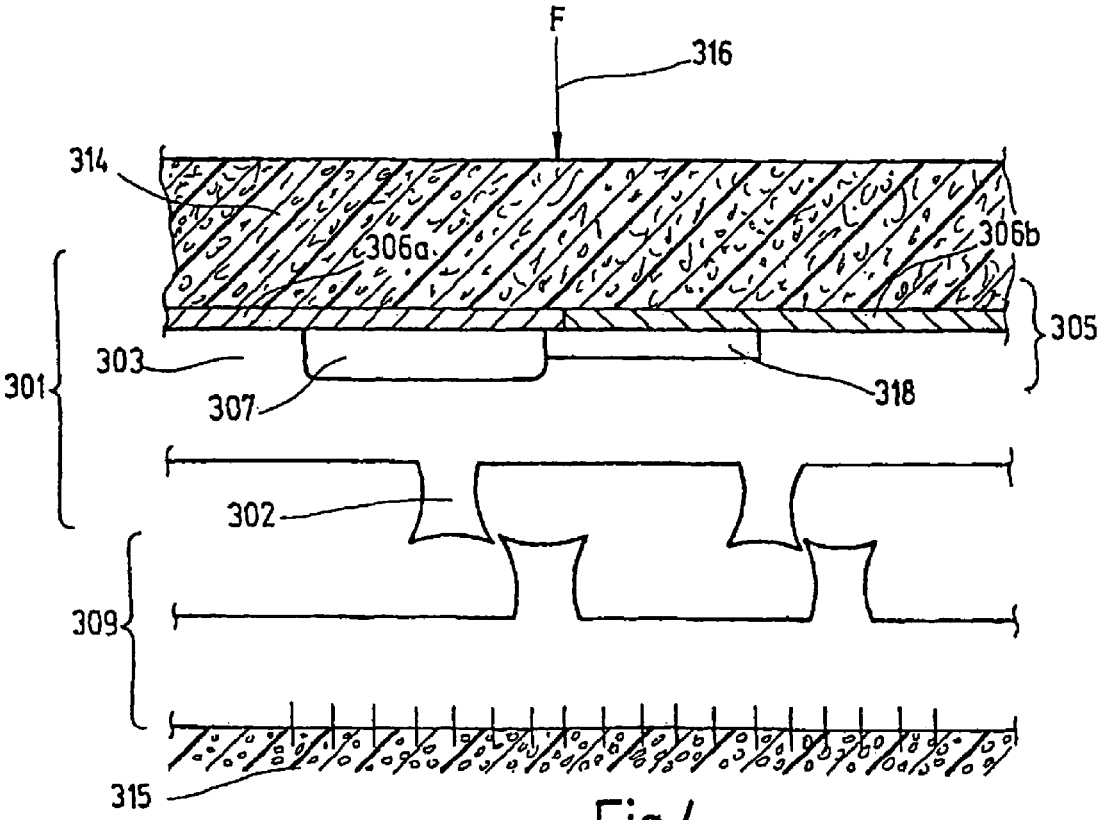
FIG. 4 is a side elevational view in section of an adhesive closure with an adhesive closure part according to a fourth exemplary embodiment of the present invention.

FIG. 4 shows a fourth embodiment of the present invention. This adhesive closure part 301 of the present invention is located in the center of the drawing. On the adhesive closure part side facing away from the adhesive closure elements 302, the circuit 305 is located. That adhesive closure part and side are securely and undetachably fixed on a textile covering 314 usable, for example, for covering the upholstery of a vehicle seat. On the surface facing away from the adhesive closure elements 302, the adhesive closure part 301 has conductor strips 306*a*, 306*b* abutting one another. The adhesive closure part 301 can be detachably fixed on an upholstery part 315 having another corresponding adhesive closure part 309 for this purpose by the adhesive closure elements 302 with the textile covering 314.

In the case of the action of a force F in the direction of the arrow 316, for example, by an individual sitting down on the vehicle seat, a more or less major deflection of the upholstery part 315 and thus also of the adhesive closure part 301 takes place. Especially, the distance and interface between the conductor strips 306*a*, 306*b* changes. This change is accompanied by a change of the electrical contact resistance which can be communicated directly or indirectly to outside the adhesive closure part 301 by the electronic component 307 integrated into the carrier 303. The electronic component 307 is provided only as an option for contactless communications and/or as an option for implementation of other control intelligence or other sensors. In particular, sensor functions can also be provided even without the electronic semiconductor component 307 in the adhesive closure part 301, for example, also pressure or moisture sensors, by the corresponding comb-like arrangements of conductor paths.

Immediately next to the semiconductor component 307 or optionally spaced apart from it, but electrically connected to it, the adhesive closure part 301 has an energy storage device 318 in thin or thick film technology. Preferably, an electrochemical energy storage device 318 is in the form of a battery or a rechargeable battery.

The conductor strips can be implemented by structured or unstructured application of metal layers. In the case of unstructured application such as, for example, vapor deposition or precipitation from the gaseous phase, subsequent structuring can take place mechanically, chemically or in some other way. All the materials used for the adhesive closure part 1, 101, 201, 301 of the present invention, especially the plastics used, are preferably recyclable and/or biologically decomposable.

While various embodiments have been chosen to illustrate the invention, it will be understood by those skilled in the art that various changes and modifications can be made therein without departing from the scope of the invention as defined in the appended claims.

What is claimed is:

1. An adhesive closure part, comprising:

a flat carrier having first and second opposite surfaces;

adhesive closure elements of electrically insulating plastic projecting from said first surface of said flat carrier and comprising at least one of hooks, mushroom-shaped members and loops, said flat carrier and said adhesive closure elements being unitary; and a circuit directly on said second surface of said flat carrier, said circuit including at least one of an electrical component and electronic component.

2. An adhesive closure part according to claim 1 wherein another electrical or electronic component is located one of in and directly on said flat carrier.

3. An adhesive closure part according to claim 1 wherein another electrical or electronic component is integrated into said flat carrier.

4. An adhesive closure part according to claim 1 wherein said one of the electrical component and electronic component comprises an application of one of thick and thin film technology.

5. An adhesive closure part according to claim 1 wherein another of an electrical or electronic component is laminated onto said flat carrier.

6. An adhesive closure part according to claim 1 wherein said circuit comprises electrical conductor strips.

7. An adhesive closure part according to claim 1 wherein said circuit comprises electrical or electronic sensors.

8. An adhesive closure part according to claim 1 wherein said circuit comprises an integrated semiconductor component.

9. An adhesive closure part according to claim 8 wherein said integrated semiconductor component comprises an electronic data memory.

10. An adhesive closure part according to claim 9 wherein said electronic data memory stores data readable without contact.

11. An adhesive closure part according to claim 10 wherein said data is storable without contact.

12. An adhesive closure part according to claim 1 wherein said circuit comprises at least one receiving coil for receiving electrical energy to operate said circuit by an electromagnetic field.

13. An adhesive closure part according to claim 1 wherein said circuit comprises an energy storage device.

14. An adhesive closure part according to claim 13 wherein said energy storage device is an electrochemical storage device being an application of thin or thick film technology.

15. An adhesive closure part according to claim 1 wherein said flat carrier and said adhesive closure elements are of at least one of the group consisting of duroplastic, thermoplastic, polymer plastic and acrylate plastic.

16. An adhesive closure part according to claim 1 wherein said circuit comprises printed electrical conductors directly on said flat carrier and connected to an electronic component.

17. An adhesive closure part according to claim 1 wherein said circuit comprises printed electrical conductors directly on said flat carrier connected to an electronic component integrated in said flat carrier.

18. An adhesive closure part according to claim 1 wherein said circuit comprises printed electrical conductors directly on said flat carrier connected to and extending from an electric component laminated directly on said flat carrier and connected to said printed electrical conductors.

19. An adhesive closure part according to claim 1 wherein said circuit comprises first and second electrical conductors directly on said flat carrier having adjacent ends abutting one another when said carrier is in one position and separated from one another when said flat carrier is in another position.

20. An adhesive closure part according to claim 1 wherein said flat carrier is flexible and electrically insulating.

21. An adhesive closure part according to claim 1 wherein said flat carrier and said adhesive closure parts are of the same electrically insulating plastic.

* * * * *